US007312681B1

(12) United States Patent
Maeda et al.

(10) Patent No.: US 7,312,681 B1
(45) Date of Patent: Dec. 25, 2007

(54) INTERNAL COMBUSTION ENGINE IGNITION APPARATUS AND METHOD FOR MANUFACTURING A SECONDARY COIL THEREOF

(75) Inventors: Masayoshi Maeda, Hyogo (JP); Takeshi Shimizu, Tokyo (JP); Shigemi Murata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/714,828

(22) Filed: Mar. 7, 2007

(30) Foreign Application Priority Data

Aug. 30, 2006 (JP) ..... 2006-233967

(51) Int. Cl.
*H01F 27/02* (2006.01)
*H01F 7/06* (2006.01)

(52) U.S. Cl. ..... 336/90; 336/92; 29/606

(58) Field of Classification Search ..... 29/605–606, 29/602.1; 336/92, 90, 96
See application file for complete search history.

(56) References Cited

U.S. PATENT DOCUMENTS 2,904,763 A * 9/1959 Harruff ..... 336/182
4,514,712 A * 4/1985 McDougal ..... 336/96
4,528,971 A * 7/1985 Huttinger et al. ..... 123/634
7,131,183 B2 * 11/2006 Burchett et al. ..... 29/602.1

FOREIGN PATENT DOCUMENTS

JP 9-45571 A 2/1997

* cited by examiner

*Primary Examiner*—Anh Mai
(74) *Attorney, Agent, or Firm*—Sughrue Mion, PLLC

(57) ABSTRACT

A transformer terminal is configured as a single part that includes: a base portion; a first connecting portion that is formed at a first end of the base portion and to which a winding finish end portion of a secondary wire can be connected; and a second connecting portion that is formed at a second end of the base portion and to which a high-voltage terminal can be connected. The base portion is mounted to a first flange portion of a secondary bobbin so as to be pivotable around an axis of the base portion such that the second connecting portion can adopt a withdrawn position that is shifted axially away from radially outside a secondary wire winding region of the secondary bobbin and a connecting position that aligns with the high-voltage terminal that is radially outside the secondary wire winding region.

9 Claims, 7 Drawing Sheets

INTERNAL COMBUSTION ENGINE IGNITION APPARATUS AND METHOD FOR MANUFACTURING A SECONDARY COIL THEREOF

BACKGROUND OF THE INVENTION

1. Field of the Invention

The present invention relates to an ignition apparatus that supplies a high voltage to a spark plug of an internal combustion engine such as an automobile engine, etc., in order to generate a spark discharge, and also relates to a method for manufacturing a secondary coil thereof.

2. Description of the Related Art

Conventional internal combustion engine ignition apparatuses are configured such that a high-voltage tower that has a high-voltage terminal inside is made to project integrally from a side surface of a resin case, a primary coil and a secondary coil that includes a connecting member in which a winding finish end portion of a secondary wire is mounted to a base portion that is bent at a right angle and that extends alongside a side surface of the secondary coil are accommodated concentrically inside an insulated case, a tip end portion of the connecting member is electrically connected to the high-voltage terminal inside the high-voltage tower, and the primary coil and the secondary coil are fixed in an electrically-insulating resin layer that is formed by injecting and hardening an insulating resin inside the insulated case (see Patent Literature 1, for example).

Now, if the connecting member is placed alongside the side surface of the secondary bobbin, the secondary wire is obstructed by the connecting member and cannot be wound onto the secondary bobbin. Thus, the connecting member onto which a winding start end portion of the secondary wire is wound has been disposed on a flange portion at a first end of the secondary bobbin, and a tie portion onto which the winding finish end portion of the secondary wire is wound has been disposed on a flange portion at a second end of the secondary bobbin. That secondary bobbin is set in a winding machine, the winding start end portion of the secondary wire is wound onto the connecting member, the secondary wire is wound onto the secondary bobbin by the winding machine, the winding finish end portion thereof is wound onto the tie portion, and then the secondary coil is removed from the winding machine. The base portion that has been bent at a right angle such that the connecting member is placed alongside the side surface of the secondary bobbin is subsequently mounted to the flange portion at the second end of the secondary bobbin, and then the winding finish end portion of the secondary wire is removed from the tie portion and wound onto the base portion.

However, the rewinding operation in which the secondary wire that is wound onto the tie portion is removed and wound onto the base portion of the connecting member cannot be automated and has had to be performed manually, hindering productivity significantly.

In order to solve this problem, the base portion of the connecting member has been mounted to the flange portion at the second end of the secondary bobbin in such a way that an extending segment that is disposed so as to extend from the base portion is not placed alongside the side surface of the secondary bobbin. That secondary bobbin is set in a winding machine, the winding start end portion of the secondary wire is wound onto the connecting member, the secondary wire is wound onto the secondary bobbin by the winding machine, the winding finish end portion thereof is wound onto the base portion, and then the secondary coil is removed from the winding machine. The extending segment of the connecting member is subsequently bent at a right angle to the base portion so as to be placed alongside the side surface of the secondary bobbin.

Patent Literature 1: Japanese Patent Laid-Open No. 2002-291184 (Gazette)

In conventional internal combustion engine ignition apparatuses, because the extending segment of the connecting member is bent at a right angle to the base portion after the secondary wire has been wound onto the secondary bobbin, large bending forces have been required to plastically deform a bent portion between the base portion and the extending segment, etc. Thus, one disadvantage has been that misalignments of the connecting member relative to the secondary bobbin arise easily due to these bending forces, requiring correction of those misalignments.

SUMMARY OF THE INVENTION

The present invention aims to solve the above problems and an object of the present invention is to provide an inexpensive internal combustion engine ignition apparatus that enables occurrence of misalignment of a transformer terminal to be suppressed by preparing a first connecting portion and a second connecting portion integrally on the transformer terminal and mounting the transformer terminal pivotably to a flange portion of a secondary bobbin such that the second connecting portion can adopt a withdrawn position and a connecting position, and to provide a method for manufacturing a secondary coil thereof.

In order to achieve the above object, according to one aspect of the present invention, there is provided an internal combustion engine ignition apparatus including: a case in which a connecting end of an external terminal is exposed internally; a transformer that is configured such that a secondary coil that is configured by winding a secondary wire onto a secondary bobbin is disposed concentrically outside a primary coil that is configured by winding a primary wire onto a primary bobbin and a magnetic pole portion of a closed magnetic circuit core is disposed at a central axial position of the primary coil, the transformer being housed inside the case such that the connecting end of the external terminal is positioned radially outside a secondary wire winding region of the secondary bobbin; a transformer terminal that connects a winding finish end portion of the secondary wire to the connecting end of the external terminal; and an insulating resin portion that is injected into and hardened inside the case such that the transformer and the transformer terminal are fixed to the case in an insulated state. The transformer terminal is configured as a single part that includes: a base portion; a first connecting portion that is formed at a first end of the base portion and to which the winding finish end portion of the secondary wire can be connected; and a second connecting portion that is formed at a second end of the base portion and to which the connecting end of the external terminal can be connected. The base portion is mounted to a first flange portion of the secondary bobbin so as to be pivotable around an axis of the base portion such that the second connecting portion can adopt a withdrawn position that is shifted axially away from radially outside the secondary wire winding region of the secondary bobbin and a connecting position that aligns with the connecting end of the external terminal that is radially outside the secondary wire winding region.

According to the present invention, because the first connecting portion and the second connecting portion are configured as a portion of the transformer terminal, costs can be reduced.

Because the second connecting portion can be positioned in a connecting position that aligns with the connecting end of the external terminals by pivoting the transformer terminal around the axis of the base portion, large forces for plastically deforming the transformer terminal, etc., are no longer necessary, suppressing occurrence of misalignment of the transformer terminal relative to the secondary bobbin. Thus, the occurrence of misalignment between the second connecting portion and the connecting end of the external terminal can be suppressed by preparing the terminal 13 precisely, eliminating the need for operations for correcting misalignment, thereby enabling costs to be reduced.

Because the transformer terminal can be pivoted around the axis of the base portion to position the second connecting portion in the withdrawn position while winding the secondary wire onto the secondary bobbin, the secondary wire can be wound onto the secondary bobbin easily and efficiently without being obstructed by the transformer terminal.

DETAILED DESCRIPTION OF THE PREFERRED EMBODIMENTS

Embodiment 1

Figure 1:
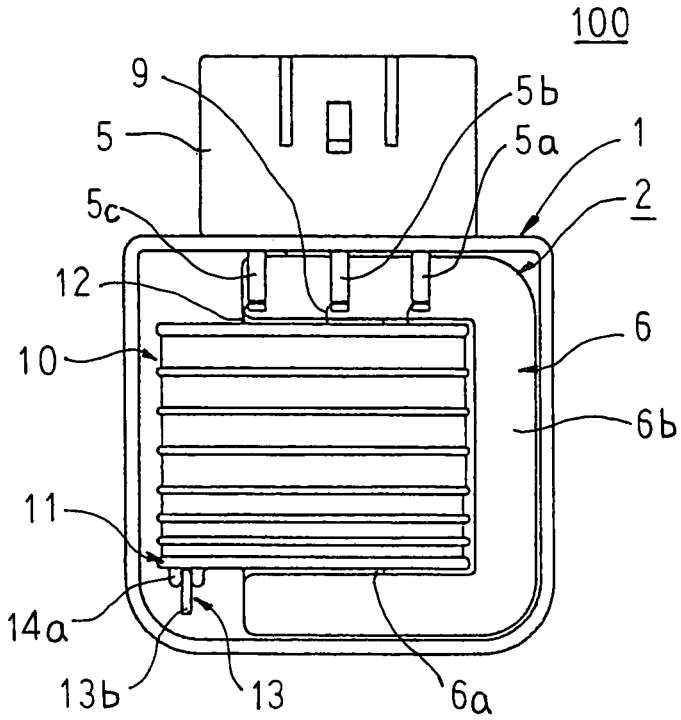
FIG. 1 is a front elevation that shows a state of an internal combustion engine ignition apparatus according to Embodiment 1 of the present invention before injection of an insulating resin.
Figure 2:
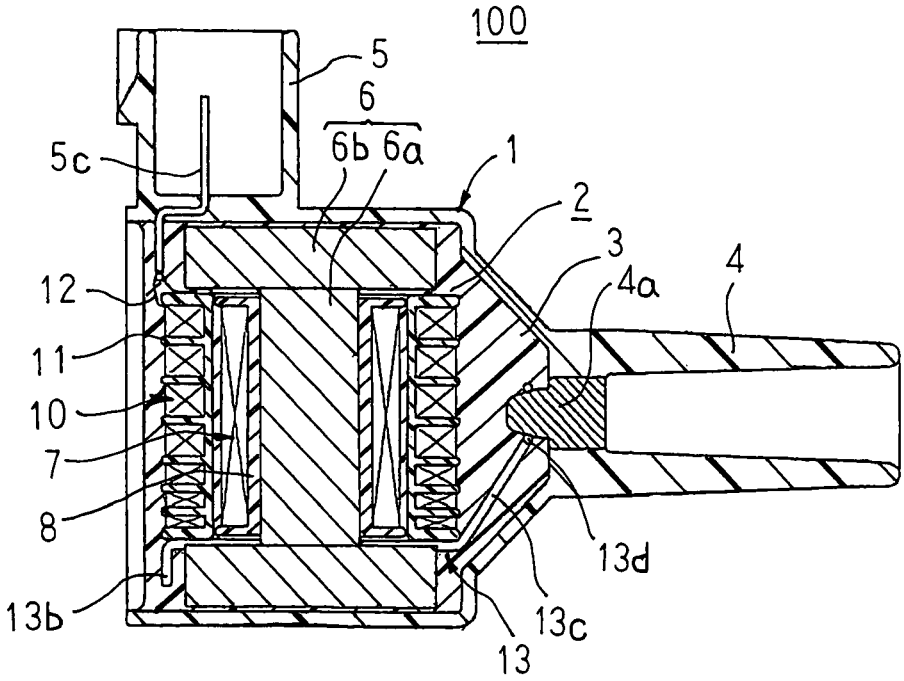
FIG. 2 is a cross section of the internal combustion engine ignition apparatus according to Embodiment 1 of the present invention.
Figure 3:
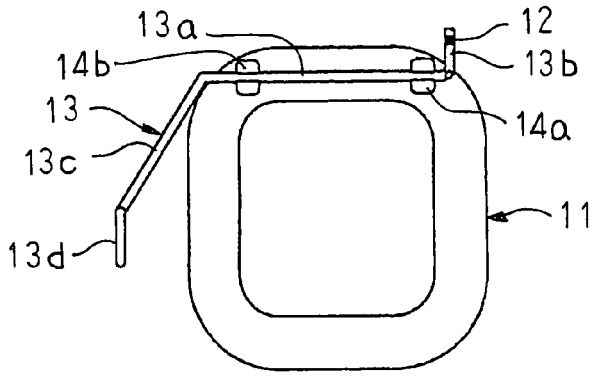
FIG. 3 is a bottom plan that shows a state in which a secondary wire is wound onto a secondary coil in the internal combustion engine ignition apparatus according to Embodiment 1 of the present invention.
Figure 4:
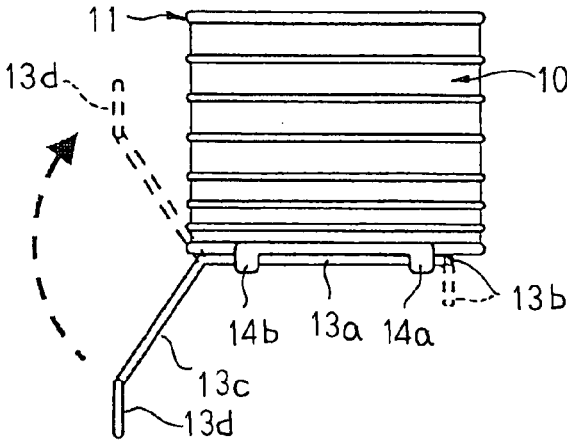
FIG. 4 is a side elevation of the secondary coil in the internal combustion engine ignition apparatus according to Embodiment 1 of the present invention that is viewed from a direction that is perpendicular to a pivoting shaft of a transformer terminal.
Figure 5:
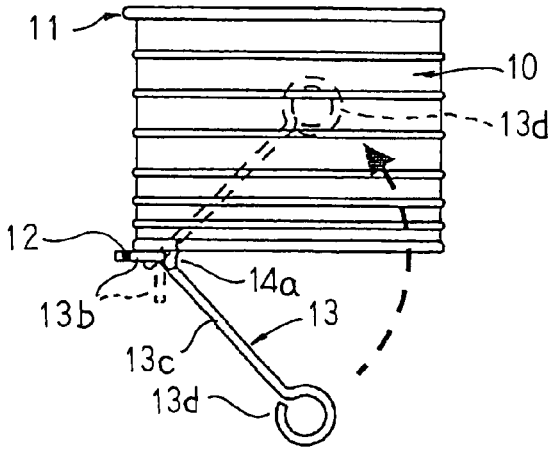
FIG. 5 is a side elevation of the secondary coil in the internal combustion engine ignition apparatus according to Embodiment 1 of the present invention that is viewed from an axial direction of the pivoting shaft of the transformer terminal.

FIG. 1 is a front elevation that shows a state of an internal combustion engine ignition apparatus according to Embodiment 1 of the present invention before injection of an insulating resin, FIG. 2 is a cross section of the internal combustion engine ignition apparatus according to Embodiment 1 of the present invention, FIG. 3 is a bottom plan that shows a state in which a secondary wire is wound onto a secondary coil in the internal combustion engine ignition apparatus according to Embodiment 1 of the present invention, FIG. 4 is a side elevation of the secondary coil in the internal combustion engine ignition apparatus according to Embodiment 1 of the present invention that is viewed from a direction that is perpendicular to a pivoting shaft of a transformer terminal, and FIG. 5 is a side elevation of the secondary coil in the internal combustion engine ignition apparatus according to Embodiment 1 of the present invention that is viewed from an axial direction of the pivoting shaft of the transformer terminal.

In FIGS. 1 and 2, an ignition apparatus 100 includes: a resin case 1; a transformer 2 that is housed inside the case 1; and an insulating resin portion 3 that is injected into and hardened inside the case 1 so as to fix the transformer 2 in an insulated state.

A high-voltage tower 4 that has a high-voltage terminal 4*a* inside that functions as an external terminal is disposed so as to project integrally from a side surface of the case 1 and a portion of the case 1 that is opposite a projecting position of the high-voltage tower 4 is formed into an opening. A connector 5 that has connector terminals 5*a* through 5*c* is disposed so as to project integrally from an upper surface of the case 1. Here, the high-voltage terminal 4*a* and the connector terminals 5*a* through 5*c* are simultaneously insert molded when the case 1 is molded, and connecting ends of the high-voltage terminal 4*a* and the connector terminals 5*a* through 5*c* are exposed inside the case 1.

The transformer 2 has: a closed magnetic circuit core 6; a primary coil 7 that is configured by winding a primary wire 9 onto a primary bobbin 8 that is disposed so as to surround a magnetized portion 6*a* of the closed magnetic circuit core 6; and a secondary coil 10 that is configured by winding a secondary wire 12 onto a secondary bobbin 11 that is disposed concentrically so as to surround the primary coil 7. This transformer 2 is housed inside the case 1 through the opening such that central portions of side surfaces of the concentrically-disposed primary coil 7 and secondary coil 10 face the high-voltage terminal 4*a*, and a winding finish end portion of the secondary wire 12 that constitutes the secondary coil 10 is electrically connected to the high-voltage terminal 4*a* by means of a transformer terminal 13.

The closed magnetic circuit core 6 is prepared by laminating a plurality of thin electromagnetic steel plates that are formed so as to have an angular frame shape, and an angular C-shaped nonmagnetized portion 6*b* that excludes the magnetized portion 6*a* is covered by a buffering material such as a resin, a rubber, a thermoplastic elastomer, etc., for example. The primary coil 7 is configured such that first and second connecting members (not shown) are disposed on flange portions at two ends of the primary bobbin 8, and the primary wire 9 is wound onto the primary bobbin 8 such that a winding start end portion thereof is wound onto the first connecting member and a winding finish end portion is wound onto the second connecting member.

Next, configuration of the secondary coil 10 will be explained with reference to FIGS. 3 through 5.

The secondary bobbin 11 is prepared into a tubular body that can be disposed coaxially externally around the primary bobbin 8, and first and second holding portions 14*a* and 14*b* are disposed integrally on an edge portion of a flange portion at a second end of the secondary bobbin 11. The first and second holding portions 14*a* and 14*b* are each formed so as to have an angular C shape that has a housing groove that elastically holds a base portion 13*a* of the transformer terminal 13, and are disposed so as to be separated by a predetermined distance so as to face each other with groove directions of their housing grooves aligned. The transformer terminal 13 is prepared by bending and shaping a metal rod, and has: a rectilinear base portion 13*a* that has a predetermined length; a first connecting portion 13*b* that is disposed so as to extend at a right angle from a first end of the base portion 13*a*; a projecting segment 13*c* that is disposed so as to extend at a predetermined angle from a second end of the base portion 13*a*; and a ring-shaped second connecting portion 13*d* that is formed on a leading end of the projecting segment 13*c*. The transformer terminal 13 is held by the secondary bobbin 11 so as to be pivotable around an axis of the base portion 13*a* by fitting the base portion 13*a* into the housing grooves of the first and second holding portions 14*a* and 14*b*.

Here, the transformer terminal 13 pivots around the axis of the base portion 13*a* so as to adopt a withdrawn position that is indicated by the solid lines in FIGS. 3 through 5, and a connecting position that is indicated by the broken lines in FIGS. 3 through 5. Specifically, in the withdrawn position, the first connecting portion 13*b* extends radially outward such that its longitudinal direction is parallel to and in close proximity to the second end surface of the secondary bobbin 11, and the second connecting portion 13*d* is shifted axially away from radially outside a region of the secondary bobbin 11 in which the secondary wire 12 is wound. In the connecting position, the first connecting portion 13*b* stands up such that its longitudinal direction is at a right angle to the second end surface of the secondary bobbin 11, the projecting segment 13*c* extends alongside the region of the secondary bobbin 11 in which the secondary wire 12 is wound, and the second connecting portion 13*d* is positioned radially outside an approximately central portion of the region of the secondary bobbin 11 in which the secondary wire 12 is wound.

To produce an ignition apparatus 100 that is configured in this manner, first a secondary bobbin 11 in which a transformer terminal 13 has been pivoted around the axis of a base portion 13*a* to the withdrawn position is set in a winding machine (not shown). Then, a secondary wire 12 is wound onto a winding region of the secondary bobbin 11 from a first end portion to a second end portion by the winding machine. Next, a winding finish end portion of the secondary wire 12 is wound onto a first connecting portion 13*b*, and then the secondary bobbin 11 is removed from the winding machine to obtain a secondary coil 10. Next, the transformer terminal 13 is pivoted around the axis of the base portion 13*a* to the connecting position.

Then, a primary bobbin 8 onto which a primary coil 7 has been wound is inserted concentrically into the secondary bobbin 11 onto which the secondary coil 10 has been wound, and a magnetized portion 6*a* of a closed magnetic circuit core 6 is inserted at a central axial position of the primary bobbin 8. Next, a transformer 2 is assembled by linking two ends of the magnetized portion 6*a* to a nonmagnetized portion 6*b*.

Then, the transformer 2 is inserted into a case 1 through the opening such that an axially central portion of the secondary coil 10 faces the connecting end of a high-voltage terminal 4*a*. Then, a second connecting portion 13*d* is connected electrically to the connecting end of the high-voltage terminal 4*a*, a winding start end portion and a winding finish end portion of the primary wire 9 are connected electrically to connecting ends of connector terminals 5*a* and 5*b*, and a winding start end portion of the secondary wire 12 is connected electrically to a connecting end of a connector terminal 5*c*. Next, a thermosetting insulating resin such as an epoxy resin, etc., is injected into the case 1 and hardened. An ignition apparatus 100 is thereby obtained in which the transformer 2 is fixed to the case 1 in an insulated state by an insulating resin portion 3.

According to Embodiment 1, because the first connecting portion 12*b* that is connected to the winding finish end portion of the secondary wire 12 and the second connecting portion 13*d* that is connected to the high-voltage terminal 4*a* are constituted by a single part, costs can be reduced.

Because the transformer terminal 13 is pivoted around the axis of the base portion 13*a* so as to be positioned in the connecting position in which the second connecting portion 13*d* can be connected to the high-voltage terminal 4*a*, unnecessary forces for plastically deforming the transformer terminal 13, etc., are not applied, suppressing the likelihood that the transformer terminal 13 will become misaligned relative to the secondary bobbin 11. Thus, the occurrence of misalignment between the second connecting portion 13*d* and the high-voltage terminal 4*a* can be suppressed by preparing the transformer terminal 13 precisely, eliminating the need for operations for correcting misalignments, thereby enabling costs to be reduced.

Because the transformer terminal 13 is pivoted around the axis of the base portion 13*a* to position the second connecting portion 13*d* in the withdrawn position while winding the secondary wire 12 onto the secondary bobbin 11, the secondary wire 12 can be wound onto the secondary bobbin 11 easily and efficiently without being obstructed by the transformer terminal 13. Because the second connecting portion 13*d* projects radially outward from the second end surface of the secondary bobbin 11, a connecting operation in which the winding finish end portion of the secondary wire 12 is wound onto the second connecting portion 13*d* and soldered is also facilitated.

When the transformer terminal 13 is pivoted around the axis of the base portion 13*a* to position the second connecting portion 13*d* in the connecting position, the first connecting portion 13*b* stands up at a right angle from the second end surface of the secondary bobbin 11. Thus, because the first connecting portion 13*b* extends outward from the second end surface of the secondary bobbin 11 so as to be parallel to an axial direction of the secondary bobbin 11, when the transformer 2 is housed inside the case 1, the first connecting portion 13*b* is housed inside dead space that is bounded by the case 1 and the nonmagnetized portion 6*b* of the closed magnetic circuit core 6, which are in close proximity. Thus, an ignition apparatus that has good layout characteristics without unnecessary protrusions can be achieved.

Embodiment 2

Figure 6:
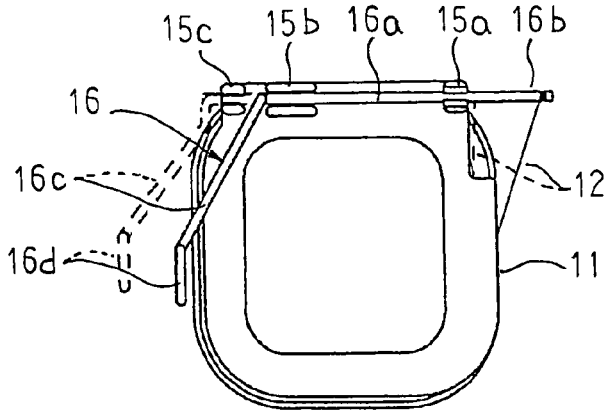
FIG. 6 is a bottom plan that shows a state in which a secondary wire is wound onto a secondary coil in an internal combustion engine ignition apparatus according to Embodiment 2 of the present invention.
Figure 7:
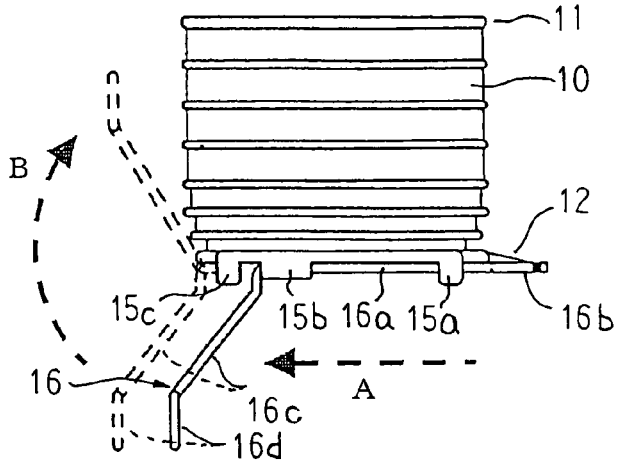
FIG. 7 is a side elevation of the secondary coil in the internal combustion engine ignition apparatus according to Embodiment 2 of the present invention that is viewed from a direction that is perpendicular to a pivoting shaft of a transformer terminal.
Figure 8:
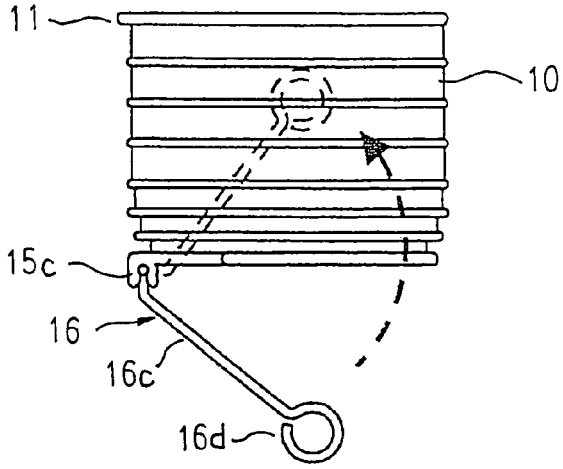
FIG. 8 is a side elevation of the secondary coil in the internal combustion engine ignition apparatus according to Embodiment 2 of the present invention that is viewed from an axial direction of the pivoting shaft of the transformer terminal.

FIG. 6 is a bottom plan that shows a state in which a secondary wire is wound onto a secondary coil in an internal combustion engine ignition apparatus according to Embodiment 2 of the present invention, FIG. 7 is a side elevation of the secondary coil in the internal combustion engine ignition apparatus according to Embodiment 2 of the present invention that is viewed from a direction that is perpendicular to a pivoting shaft of a transformer terminal, and FIG. 8 is a side elevation of the secondary coil in the internal combustion engine ignition apparatus according to Embodiment 2 of the present invention that is viewed from an axial direction of the pivoting shaft of the transformer terminal.

In FIGS. 6 through 8, a first holding portion 15*a*, a second holding portion 15*b*, and a third holding portion 15*c* are disposed integrally on a flange portion at a second end of a secondary bobbin 11. The first holding portion 15*a*, the second holding portion 15*b*, and the third holding portion 15*c* are each formed so as to have an angular C shape that has a housing groove that elastically holds a base portion 16*a* of a transformer terminal 16. The first holding portion 15*a* and the second holding portion 15*b* are disposed so as to be separated by a predetermined distance so as to face each other with groove directions of their housing grooves aligned. In addition, the third holding portion 15*c* is disposed in close proximity to the second holding portion 15*b* on an opposite side from the first holding portion 15*a* such that the groove directions of their housing grooves align.

The transformer terminal 16 is prepared by bending and shaping a metal rod, and has: a rectilinear base portion 16*a* that has a predetermined length; a first connecting portion 16*b* that is disposed so as to extend coaxially from a first end of the base portion 13*a*; a projecting segment 16*c* that is disposed so as to be bent at a right angle from a second end of the base portion 16*a* and then extend at a predetermined angle; and a ring-shaped second connecting portion 16*d* that is formed on a leading end of the projecting segment 16*c*.

The transformer terminal 16 is held by the secondary bobbin 11 so as to be pivotable around an axis of the base portion 16*a* by fitting the base portion 16*a* into the housing grooves of the first and second holding portions 15*a* and 15*b*. The transformer terminal 16 can also be moved in a longitudinal direction of the base portion 16*a*, as indicated by arrow A in FIG. 7. When moved in the direction of arrow A, the transformer terminal 16 is held by the secondary bobbin 11 so as to be pivotable around the axis of the base portion 16*a* by fitting the base portion 16*a* into the housing grooves of the first, second, and third holding portions 15*a*, 15*b*, and 15*c*.

Here, the transformer terminal 16 pivots around the axis of the base portion 16*a* so as to adopt a withdrawn position that is indicated by the solid lines in FIGS. 6 through 8, and a connecting position that is indicated by the broken lines in FIGS. 6 through 8. Specifically, in the withdrawn position, the first connecting portion 16*b* extends radially outward such that its longitudinal direction is parallel to and in close proximity to the second end surface of the secondary bobbin 11, the projecting segment 16*c* extends outward from a gap between the second holding portion 16*b* and the third holding portion 16*c*, and the second connecting portion 16*d* is shifted axially away from radially outside a region of the secondary bobbin 11 in which the secondary wire 12 is wound. In the connecting position, the first connecting portion 16*b* does not project radially outward from the second end surface of the secondary bobbin 11, the projecting segment 16*c* extends alongside the region of the secondary bobbin 11 in which the secondary wire 12 is wound from outside the third holding portion 15*c*, and the second connecting portion 16*d* is positioned radially outside an approximately central portion of the region of the secondary bobbin 11 in which the secondary wire 12 is wound.

A method for manufacturing an ignition apparatus according to Embodiment 2 will now be explained.

First, a secondary bobbin 11 in which a transformer terminal 16 has been pivoted around the axis of a base portion 16*a* to the withdrawn position is set in a winding machine (not shown). Then, a secondary wire 12 is wound onto the secondary bobbin 11 from a first end portion to a second end portion by the winding machine. Next, a winding finish end portion of the secondary wire 12 is wound onto a first connecting portion 16*b*, and then the secondary bobbin 11 is removed from the winding machine to obtain a secondary coil 10. Next, the transformer terminal 16 is moved in an axial direction of the base portion 16*a*, as indicated by arrow A in FIG. 7, and then the transformer terminal 16 is pivoted around the axis of the base portion 16*a* to the connecting position, as indicated by arrow B.

Then, in a similar manner to Embodiment 1 above, a transformer is assembled, the transformer is housed inside a case, a predetermined connecting operation is performed, and then an insulating resin is injected and hardened to obtain an ignition apparatus.

Consequently, similar effects to those in Embodiment 1 above can also be achieved in Embodiment 2.

According to Embodiment 2, because the first connecting portion 16*b* is disposed so as to extend coaxially at the first end of the base portion 16*a* and is configured so as to be able to extend and retract radially from and into the end portion of the secondary bobbin 11 together with axial movement of the base portion 16*a* of the transformer terminal 16, the amount of projection radially outward from the secondary bobbin 11 when the transformer terminal 16 is in the withdrawn position can be increased. Thus, solder splattering can be suppressed during soldering operations when the winding finish end portion of the secondary wire 12 is being connected to the first connecting portion 16*b*. The occurrence of internal short-circuiting due to solder splattering is thereby suppressed, increasing product reliability.

Because the first connecting portion 16*b* is embedded in the first holding portion 15*a* when the transformer terminal 16 is in the connecting position, protrusion of the first connecting portion 16*b* from the secondary bobbin 11 can be suppressed in every direction, improving layout characteristics.

Embodiment 3

Figure 9:
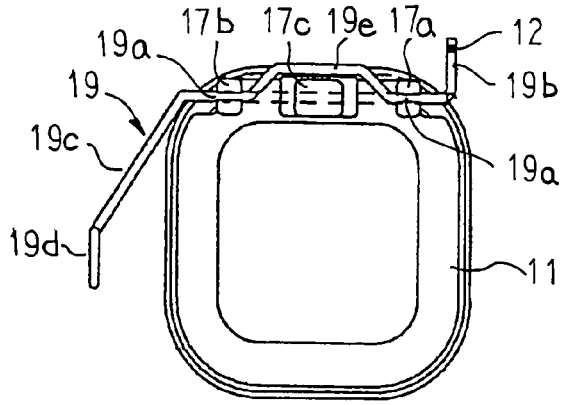
FIG. 9 is a bottom plan that shows a state in which a secondary wire is wound onto a secondary coil in an internal combustion engine ignition apparatus according to Embodiment 3 of the present invention.
Figure 10:
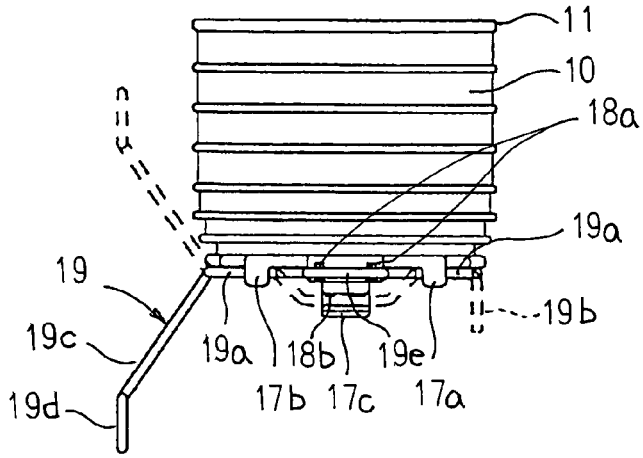
FIG. 10 is a side elevation of the secondary coil in the internal combustion engine ignition apparatus according to Embodiment 3 of the present invention that is viewed from a direction that is perpendicular to a pivoting shaft of a transformer terminal.
Figure 11:
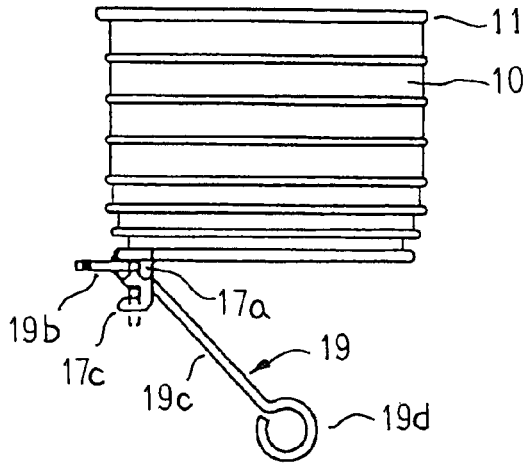
FIG. 11 is a side elevation of the secondary coil in the internal combustion engine ignition apparatus according to Embodiment 3 of the present invention that is viewed from a first axial direction of the pivoting shaft of the transformer terminal.
Figure 12:
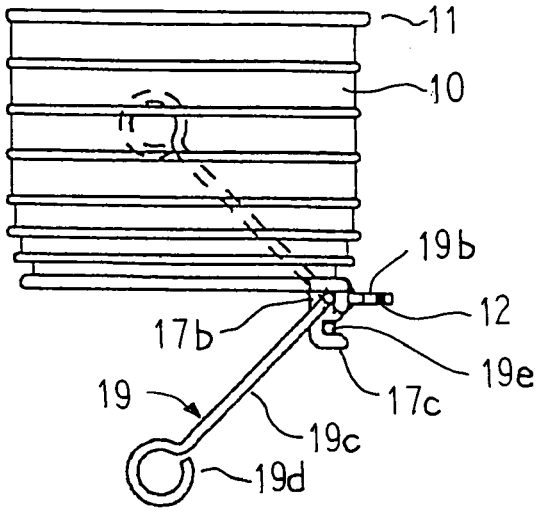
FIG. 12 is a side elevation of the secondary coil in the internal combustion engine ignition apparatus according to Embodiment 3 of the present invention that is viewed from a second axial direction of the pivoting shaft of the transformer terminal.
Figure 13:
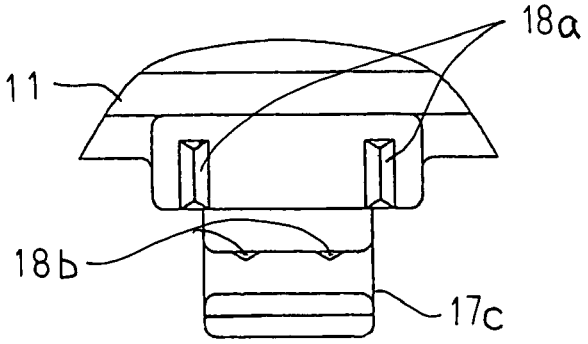
FIG. 13 is a partial front elevation that explains a configuration of a third holding portion in the internal combustion engine ignition apparatus according to Embodiment 3 of the present invention.
Figure 14:
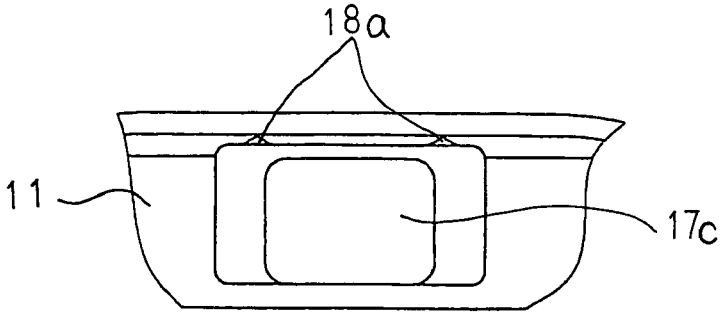
FIG. 14 is a partial top plan that explains the configuration of the third holding portion in the internal combustion engine ignition apparatus according to Embodiment 3 of the present invention.
Figure 15:
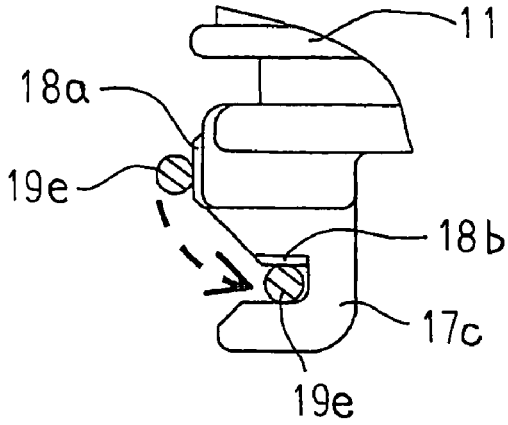
FIG. 15 is a partial side elevation that explains the configuration of the third holding portion in the internal combustion engine ignition apparatus according to Embodiment 3 of the present invention.

FIG. 9 is a bottom plan that shows a state in which a secondary wire is wound onto a secondary coil in an internal combustion engine ignition apparatus according to Embodiment 3 of the present invention, FIG. 10 is a side elevation of the secondary coil in the internal combustion engine ignition apparatus according to Embodiment 3 of the present invention that is viewed from a direction that is perpendicular to a pivoting shaft of a transformer terminal, FIG. 11 is a side elevation of the secondary coil in the internal combustion engine ignition apparatus according to Embodiment 3 of the present invention that is viewed from a first axial direction of the pivoting shaft of the transformer terminal, FIG. 12 is a side elevation of the secondary coil in the internal combustion engine ignition apparatus according to Embodiment 3 of the present invention that is viewed from a second axial direction of the pivoting shaft of the transformer terminal, FIG. 13 is a partial front elevation that explains a configuration of a third holding portion in the internal combustion engine ignition apparatus according to Embodiment 3 of the present invention, FIG. 14 is a partial top plan that explains the configuration of the third holding portion in the internal combustion engine ignition apparatus according to Embodiment 3 of the present invention, and FIG. 15 is a partial side elevation that explains the configuration of the third holding portion in the internal combustion engine ignition apparatus according to Embodiment 3 of the present invention.

In FIGS. 9 through 15, a first holding portion 17*a*, a second holding portion 17*b*, and a third holding portion 17*c* are disposed integrally on a flange portion at a second end of a secondary bobbin 11. The first holding portion 17*a* and the second holding portion 17*b* are each formed so as to have an angular C shape that has a housing groove that elastically holds a base portion 19*a* of a transformer terminal 19. The first holding portion 17*a* and the second holding portion 17*b* are disposed so as to be separated by a predetermined distance so as to face each other with groove directions of their housing grooves aligned. In addition, the third holding portion 17*c* is formed so as to have an angular C shape that has a housing groove that elastically holds a base portion 19*a* of the transformer terminal 19. The third holding portion 17*c* is disposed between the first holding portion 17*a* and the second holding portion 17*b* such that a groove direction of its housing groove is parallel and so as to be separated by a predetermined distance in an axial direction of the secondary bobbin 11. In addition, first securing lugs 18*a* that function as first terminal holding lugs are disposed so as to project from a surface of the third holding portion 17*c* that is radially outside the secondary bobbin 11, and second securing lugs 18*b* that function as second terminal holding lugs are disposed so as to project from an inner wall surface of the housing groove of the third holding portion 17*c*.

The transformer terminal 19 is prepared by bending and shaping a metal rod, and has: a base portion 19*a* that is fitted into and held by the housing grooves of the first and second holding portions 17*a* and 17*b*; a first connecting portion 19*b* that is disposed so as to extend at a right angle from a first end of the base portion 19*a*; a projecting segment 19*c* that is disposed so as to extend at a predetermined angle from a second end of the base portion 19*a*; a ring-shaped second connecting portion 19*d* that is formed on a leading end of the projecting segment 19*c*; and an engaging portion 19*e* that is displaced by a predetermined distance relative to the base portion 19*a* on an intermediate portion of the base portion 19*a*. The transformer terminal 19 is held by the secondary bobbin 11 so as to be pivotable around an axis of the base portion 19*a* by fitting the base portion 19*a* into the housing grooves of the first and second holding portions 17*a* and 17*b*.

Here, the transformer terminal 19 pivots around the axis of the base portion 19*a* so as to adopt a withdrawn position that is indicated by the solid lines in FIGS. 9 through 12, and a connecting position that is indicated by the broken lines in FIGS. 9 through 12. Specifically, in the withdrawn position, the first connecting portion 19*b* extends radially outward such that its longitudinal direction is parallel to and in close proximity to the second end surface of the secondary bobbin 11, the projecting segment 19*c* extends outward from the second holding portion 17*b*, and the second connecting portion 19*d* is shifted axially away from radially outside a region of the secondary bobbin 11 in which the secondary wire 12 is wound. The engaging portion 19*e* is elastically secured by engaging with the first securing lugs 18*a*, holding the transformer terminal 19 in the withdrawn position.

In the connecting position, the first connecting portion 19*b* stands up at a right angle to the second end surface of the secondary bobbin 11, the projecting segment 19*c* extends alongside the region of the secondary bobbin 11 in which the secondary wire 12 is wound, and the second connecting portion 19*d* is positioned radially outside an approximately central portion of the region of the secondary bobbin 11 in which the secondary wire 12 is wound. The engaging portion 19*e* is accommodated in the housing groove of the third holding portion 17*c* and is elastically secured by engaging with the second securing lugs 18*b*, holding the transformer terminal 19 in the connecting position.

Here in Embodiment 3, a secondary bobbin 11 in which a transformer terminal 19 has been pivoted around the axis of a base portion 19*a* to the withdrawn position is also set in a winding machine (not shown) and a secondary wire 12 is wound onto the secondary bobbin 11 from a first end portion to a second end portion. Next, a winding finish end portion of the secondary wire 12 is wound onto a first connecting portion 19*b*, and then the secondary bobbin 11 is removed from the winding machine to obtain a secondary coil 10. Next, the transformer terminal 19 is pivoted around the axis of the base portion 19*a* to the connecting position. Then, a transformer is assembled, the transformer is housed inside a case, a predetermined connecting operation is performed, and then an insulating resin is injected and hardened to obtain an ignition apparatus.

Consequently, similar effects to those in Embodiment 1 above can also be achieved in Embodiment 3.

According to Embodiment 3, because the first and second securing lugs 18*a* and 18*b* are disposed such that the engaging portion 19*e* of the transformer terminal 19 is secured elastically by engaging with the first and second securing lugs 18*a* and 18*b*, the transformer terminal 19 can be held in the withdrawn position or the connecting position. Thus, problems such as the transformer terminal 19 pivoting, coming into contact with the secondary wire 12, and breaking the secondary wire 12 during the operation of winding the secondary wire 12 onto the secondary bobbin 11, etc., are prevented. In addition, problems such as the transformer terminal 19 pivoting and giving rise to misalignments during handling of the transformer, etc., can also be prevented.

Embodiment 4

Figure 16:
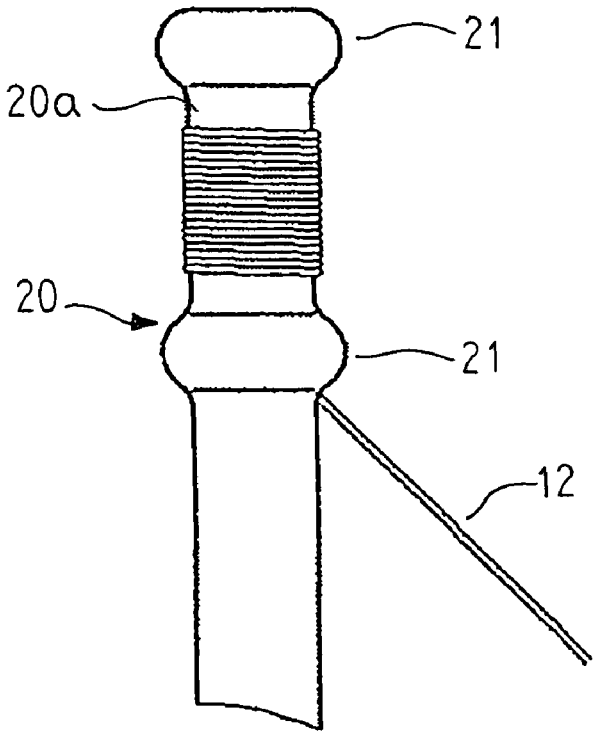
FIG. 16 is a partial side elevation that explains a configuration of a first connecting portion of a transformer terminal in an internal combustion engine ignition apparatus according to Embodiment 4 of the present invention.

FIG. 16 is a partial side elevation that explains a configuration of a first connecting portion of a transformer terminal in an internal combustion engine ignition apparatus according to Embodiment 4 of the present invention.

In FIG. 16, annular lugs 21 are disposed on opposite sides of a secondary wire tie portion of a first connecting portion 20*a* of a transformer terminal 20 so as to project from the first connecting portion 20*a*.

Moreover, the rest of this embodiment is configured in a similar manner to Embodiment 1 above.

Consequently, similar effects to those in Embodiment 1 above can also be achieved in Embodiment 4.

Furthermore, according to Embodiment 4, axial movement of the secondary wire 12 that has been wound onto the first connecting portion 20*a* is restricted by the lugs 21. Thus, problems such as the wire in the tie portion of the secondary wire 12 moving, being caught against the secondary bobbin 11, and breaking when the transformer terminal 20 is pivoted, etc., are prevented.

Embodiment 5

Figure 17:
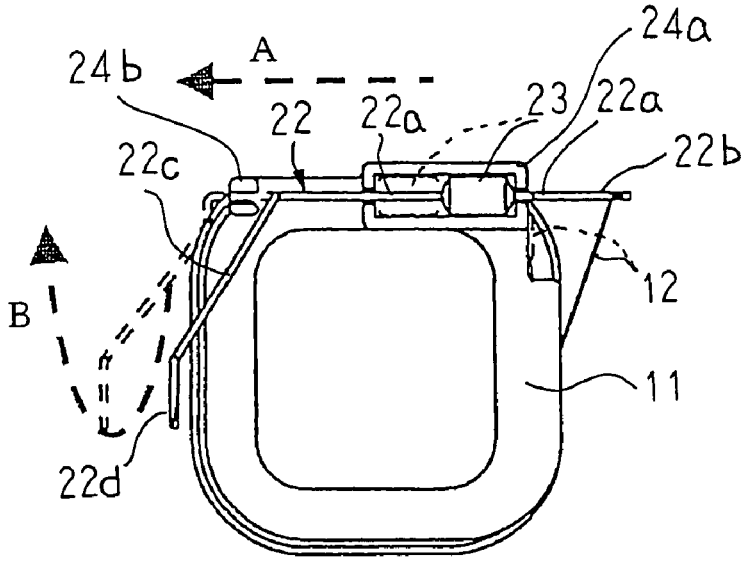
FIG. 17 is a bottom plan that shows a state in which a secondary wire is wound onto a secondary coil in an internal combustion engine ignition apparatus according to Embodiment 5 of the present invention.

FIG. 17 is a bottom plan that shows a state in which a secondary wire is wound onto a secondary coil in an internal combustion engine ignition apparatus according to Embodiment 5 of the present invention.

In FIG. 17, a transformer terminal 22 is constituted by an electronic component 23 that has first and second lead wires at two ends. The first and second lead wires at the two ends of the electronic component 23 extend in a straight line to constitute a base portion 22*a*, and the first lead wire that constitutes the base portion 22*a* is further extended in a straight line to constitute a first connecting portion 22*b*. The second lead wire that constitutes the base portion 22*a* is bent at a predetermined angle to constitute a projecting segment 22*c*, and a second connecting portion 22*d* is also formed on a leading end of the projecting segment 22*c*.

A first holding portion 24*a* and a second holding portion 24*b* are disposed integrally on a flange portion at a second end of the secondary bobbin 11. The first holding portion 24*a* is formed so as to have a frame shape such that the electronic component 23 that constitutes the transformer terminal 22 is housed so as to be movable in an axial direction of the base portion 22*a*, and housing grooves that elastically hold the base portion 22*a* are formed on two facing sides. The second holding portion 24*b* is formed so as to have an angular C shape that has housing grooves that elastically hold the base portion 22*a*. The first holding portion 24*a* and the second holding portion 24*b* are disposed so as to be separated by a predetermined distance so as to face each other with groove directions of their housing grooves aligned.

Moreover, the rest of this embodiment is configured in a similar manner to Embodiment 2 above.

In Embodiment 5, the transformer terminal 22 is held by the secondary bobbin 11 so as to be pivotable around an axis of the base portion 22*a* by housing the electronic component 23 inside the first holding portion 24*a* and fitting the base portion 22*a* into the housing grooves of the second holding portion 24*b*. The transformer terminal 22 can also be moved in a longitudinal direction of the base portion 22*a*, as indicated by arrow A in FIG. 17. When moved in the direction of arrow A, the transformer terminal 22 is held by the secondary bobbin 11 so as to be pivotable around the axis of the base portion 22*a* as indicated by arrow B in FIG. 17 by fitting the base portion 22*a* into the housing grooves of the first and second holding portions 24*a* and 24*b*.

Here, the transformer terminal 22 pivots around the axis of the base portion 22*a* so as to adopt a withdrawn position that is indicated by the solid lines in FIG. 17, and a connecting position that is indicated by the broken lines in FIG. 17. Specifically, in the withdrawn position, the first connecting portion 22*b* extends radially outward such that its longitudinal direction is parallel to and in close proximity to the second end surface of the secondary bobbin 11, and the second connecting portion 22*d* is shifted axially away from radially outside a region of the secondary bobbin 11 in which the secondary wire 12 is wound. In the connecting position, the first connecting portion 22*b* does not project radially outward from the second end surface of the secondary bobbin 11, the projecting segment 22*c* extends alongside the region of the secondary bobbin 11 in which the secondary wire 12 is wound from outside the second holding portion 24*b*, and the second connecting portion 22*d* is positioned radially outside an approximately central portion of the region of the secondary bobbin 11 in which the secondary wire 12 is wound.

Consequently, similar effects to those in Embodiment 2 above can also be achieved in Embodiment 5.

Furthermore, according to Embodiment 5, an electronic component that is used in the ignition apparatus such as an ON voltage restraining diode, a discharge noise suppressing resistor, etc., can be used in the transformer terminal, enabling a reduction in the number of parts.

Embodiment 6

Figure 18:
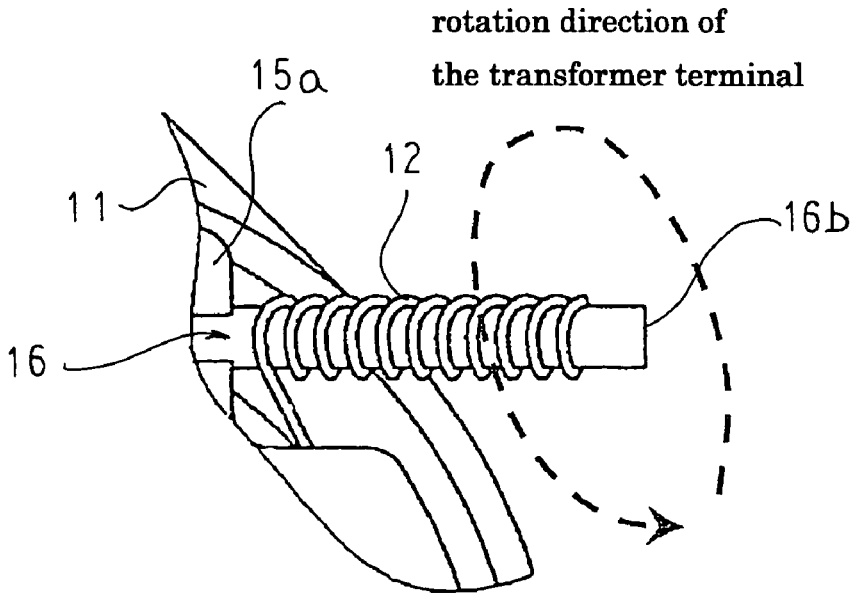
FIG. 18 is a partial perspective that explains a state in which a secondary wire is wound onto a first connecting portion of a transformer terminal in an internal combustion engine ignition apparatus according to Embodiment 6 of the present invention.

FIG. 18 is a partial perspective that explains a state in which a secondary wire is wound onto a first connecting portion of a transformer terminal in an internal combustion engine ignition apparatus according to Embodiment 6 of the present invention.

In FIG. 18, a winding finish end portion of a secondary wire 12 is wound onto a first connecting portion 16*b* in a direction that generates slack when a transformer terminal 16 is pivoted from a withdrawn position to a connecting position.

Moreover, the rest of this embodiment is configured in a similar manner to Embodiment 2 above.

According to Embodiment 6, problems such as the secondary wire 12 being pulled taut and breaking when the transformer terminal 16 is pivoted from the withdrawn position to the connecting position, etc., are prevented.

What is claimed is:

1. An internal combustion engine ignition apparatus comprising:

a case in which a connecting end of an external terminal is exposed internally;

a transformer that is configured such that a secondary coil that is configured by winding a secondary wire onto a secondary bobbin is disposed concentrically outside a primary coil that is configured by winding a primary wire onto a primary bobbin and a magnetic pole portion of a closed magnetic circuit core is disposed at a central axial position of said primary coil, said transformer being housed inside said case such that said connecting end of said external terminal is positioned radially outside a secondary wire winding region of said secondary bobbin;

a transformer terminal that connects a winding finish end portion of said secondary wire to said connecting end of said external terminal; and an insulating resin portion that is injected into and hardened inside said case such that said transformer and said transformer terminal are fixed to said case in an insulated state, wherein:

said transformer terminal is configured as a single part that includes:

a base portion;

a first connecting portion that is formed at a first end of said base portion and to which said winding finish end portion of said secondary wire can be connected; and a second connecting portion that is formed at a second end of said base portion and to which said connecting end of said external terminal can be connected; and said base portion is mounted to a first flange portion of said secondary bobbin so as to be pivotable around an axis of said base portion such that said second connecting portion can adopt a withdrawn position that is shifted axially away from radially outside said secondary wire winding region of said secondary bobbin and a connecting position that aligns with said connecting end of said external terminal that is radially outside said secondary wire winding region.

2. An internal combustion engine ignition apparatus according to claim 1, wherein said first connecting portion is configured so as to project radially from said first flange portion of said secondary bobbin when said transformer terminal is in said withdrawn position and to project axially from said first flange portion of said secondary bobbin when said transformer terminal is in said connecting position.

3. An internal combustion engine ignition apparatus according to claim 1, wherein said base portion is mounted to said first flange portion of said secondary bobbin so as to be movable in an axial direction of said base portion, said first connecting portion is disposed so as to extend coaxially from said base portion, and said first connecting portion is configured so as to be able to extend and retract radially from and into said first flange portion of said secondary bobbin together with said axial movement of said base portion.

4. An internal combustion engine ignition apparatus according to claim 1, further comprising a first terminal holding lug that is disposed on said secondary bobbin so as to engage with and hold said transformer terminal in said withdrawn position when said transformer terminal is pivoted around said axis of said base portion to said withdrawn position; and a second terminal holding lug that is disposed on said secondary bobbin so as to engage with and hold said transformer terminal in said connecting position when said transformer terminal is pivoted around said axis of said base portion to said connecting position.

5. An internal combustion engine ignition apparatus according to claim 1, further comprising a pair of lugs that are disposed on opposite sides of a tie region of said first connecting portion such that axial movement of said secondary wire that has been wound onto said tie region is restricted.

6. An internal combustion engine ignition apparatus according to claim 3, wherein said transformer terminal is constituted by an electronic component that has lead wires at two ends.

7. An internal combustion engine ignition apparatus according to claim 1, wherein said secondary wire is wound onto said first connecting portion such that slack is generated when said transformer terminal is pivoted from said withdrawn position to said connecting position.

8. A method for manufacturing an internal combustion engine ignition apparatus secondary coil comprising steps of:

mounting a transformer terminal in which a base portion, a first connecting portion that is formed on a first end of said base portion, and a second connecting portion that is formed on a second end of said base portion are formed integrally to a first flange portion of a secondary bobbin so as to be pivotable around an axis of said base portion;

projecting said first connecting portion radially from said first flange portion of said secondary bobbin and shifting said second connecting portion axially away from radially outside a secondary wire winding region of said secondary bobbin by pivoting said transformer terminal around said axis of said base portion;

winding a secondary wire onto said secondary wire winding region of said secondary bobbin;

connecting a winding finish end portion of said secondary wire to said first connecting portion; and positioning said second connecting portion radially outside said secondary wire winding region of said secondary bobbin by pivoting said transformer terminal around said axis of said base portion.

9. A method for manufacturing an internal combustion engine ignition apparatus secondary coil according to claim 8, wherein said winding finish end portion of said secondary wire is wound onto said first connecting portion so as to generate slack when said transformer terminal is pivoted around said axis of said base portion so as to position said second connecting portion radially outside said secondary wire winding region of said secondary bobbin.

* * * * *